US009266656B2

(12) United States Patent
Walling et al.

(10) Patent No.: US 9,266,656 B2
(45) Date of Patent: Feb. 23, 2016

(54) CARTON WITH HANDLE

(75) Inventors: Bradford J. Walling, Chesterfield, VA (US); Aaron L. Bates, Moseley, VA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 533 days.

(21) Appl. No.: 13/423,170

(22) Filed: Mar. 17, 2012

(65) Prior Publication Data

US 2012/0312866 A1 Dec. 13, 2012

Related U.S. Application Data

(60) Provisional application No. 61/454,310, filed on Mar. 18, 2011.

(51) Int. Cl.
*B65D 5/46* (2006.01)
*B65D 71/36* (2006.01)

(52) U.S. Cl.
CPC ..... *B65D 71/36* (2013.01); *B65D 2571/0045* (2013.01); *B65D 2571/0066* (2013.01); *B65D 2571/00141* (2013.01); *B65D 2571/00543* (2013.01); *B65D 2571/00549* (2013.01); *B65D 2571/00574* (2013.01); *B65D 2571/00728* (2013.01)

(58) Field of Classification Search
CPC ..... B65D 2571/0066; B65D 2571/0045; B65D 5/4608; B65D 2571/00543; B65D 2571/00561; B65D 2571/00444
USPC ..... 229/117.12; 206/141, 161
See application file for complete search history.

(56) References Cited

U.S. PATENT DOCUMENTS

| | | | | |
|---|---|---|---|---|
| 3,593,849 | A | 7/1971 | Helms | |
| 4,728,026 | A | 3/1988 | Schuster | |
| 4,784,316 | A * | 11/1988 | Crouch | 229/117.13 |
| 4,785,991 | A * | 11/1988 | Schuster | 229/117.13 |
| 4,966,324 | A | 10/1990 | Steel | |
| 4,972,991 | A | 11/1990 | Schuster | |
| 4,981,253 | A | 1/1991 | Quaintance | |
| 2007/0017962 | A1 | 1/2007 | Russ | |

FOREIGN PATENT DOCUMENTS

| | | |
|---|---|---|
| WO | WO 2006/127734 | 11/2006 |
| WO | WO 2009/082724 | 7/2009 |

OTHER PUBLICATIONS

International Search Report for PCT/US2012/029566 mailed Jun. 20, 2012.

* cited by examiner

*Primary Examiner* — Christopher Demeree
(74) *Attorney, Agent, or Firm* — WestRock Intellectual Property Group

(57) ABSTRACT

A carton includes a handle (160) for carrying the carton. The handle includes a handle flap (162*a*) with a main portion (174*a*), first (178*a*) and second (180*a*) gussets, and an end portion (176*a*). The main portion is hingedly connected to the first gusset along a first fold line (182*a*), the first gusset is hingedly connected to the second gusset along a second fold line (184*a*), and the second gusset is hingedly connected to the first end portion along a third fold line (120).

12 Claims, 4 Drawing Sheets

CARTON WITH HANDLE

CROSS-REFERENCE TO RELATED APPLICATIONS

This application claims the benefit of U.S. Provisional Application No. 61/454,310, filed Mar. 18, 2011, which is incorporated herein by reference in its entirety.

FIELD OF THE INVENTION

This invention relates generally to cartons, and more particularly, to cartons with a handle.

BACKGROUND OF THE INVENTION

Cartons that encase multiple articles such as soft drink cans or bottles are useful to enable consumers to transport and store the articles. Such cartons need well-designed handles to minimize the amount of material that is used to make the carton. For example, a well-designed handle can prevent a carton made with thinner or weaker material from tearing as the handle is engaged to carry the carton of articles. By using less material, the cost of cartons can be reduced.

SUMMARY OF THE INVENTION

The present invention overcomes the shortcomings of the prior art by providing a carton for enclosing an arrangement of articles. The carton includes a tubular structure and a handle. The tubular structure includes a top wall and a first side wall and a second side wall that are hingedly connected to opposed edges of the top wall. Opposed ends each of the articles in the arrangement of articles are adjacent the first side wall and the second side wall, respectively. The handle is at least partially formed in each of the top wall, the first side wall, and the second side wall. Further, the handle is formed in the carton adjacent to an open space between two articles of the arrangement of cylindrical articles. The handle includes a handle flap having a main portion formed from part of the top wall, a first gusset and a second gusset formed from part of the top wall, and a first end portion formed from part of the first side wall. The main portion is hingedly connected to the first gusset along a first fold line, the first gusset is hingedly connected to the second gusset along a second fold line, and the second gusset is hingedly connected to the first end portion along a third fold line that hingedly connects the top wall to the first side wall. As such, the handle is configured to fold around an adjacent article and reduce stresses in the carton when the handle is engaged.

The foregoing has broadly outlined some of the aspects and features of the present invention, which should be construed to be merely illustrative of various potential applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
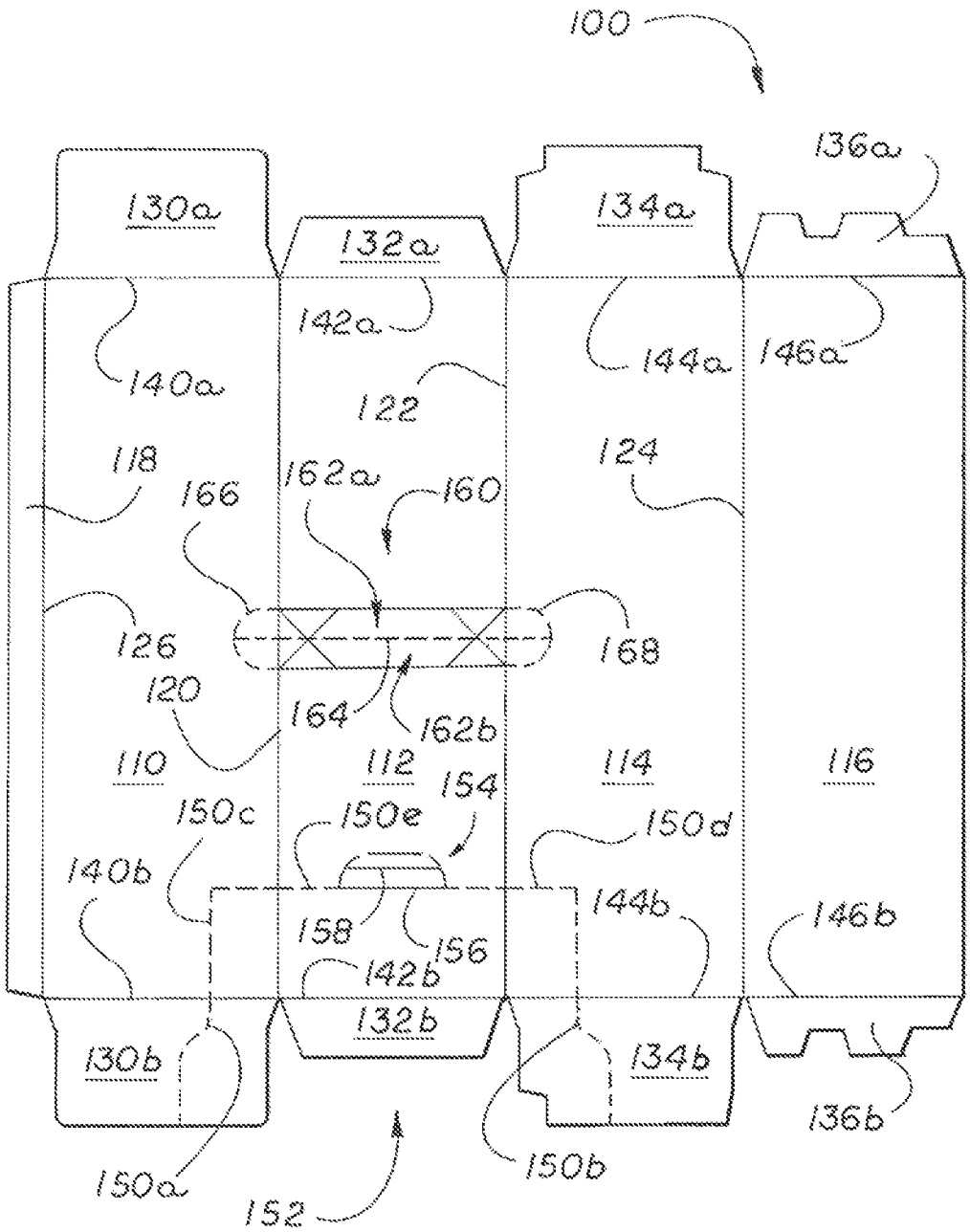
FIG. 1 is a plan view of a carton blank in accordance with an exemplary embodiment of the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of exemplary embodiments of a carton. In the embodiments detailed herein, the term carton refers, for the non-limiting purpose of illustrating the various features of the invention, to a container for enclosing, carrying, and dispensing articles, such as beverage cans. However, it is contemplated that the teachings of the invention can be applied to various containers. Generally described, exemplary cartons include a tubular structure that is defined by a top wall, first and second side walls, and a bottom wall and includes end closure structures that define end walls at each of the open ends of the tubular structure.

Referring to the exemplary embodiment illustrated in FIGS. 1-4, a carton 200 is formed from a blank 100, with the inside surface of the blank 100 shown. The opposite side (not shown) of the blank 100 is its outside surface. The outside surface may be used as its art side for printing product information, decorative designs, and brand specific indicia, such as logos, trademarks and associated copy. Either or both the inside and outside surface may be laminated or otherwise treated to make the carton water-resistant, more durable, or to insulate the contents of the carton.

The blank 100 includes a sheet of suitable substrate. It is to be understood that, as used herein, the term "suitable substrate" includes all manner of foldable sheet material such as paperboard, corrugated board, cardboard, plastic, combinations thereof, and the like. In the illustrated embodiments, the unitary blank 100 is used to form a single carton 200. However, it should be recognized that two or more blanks may be employed, for example, to provide the carton structure described in more detail below.

In the exemplary embodiment, the blank 100 is configured to form a carton for packaging an exemplary arrangement of exemplary articles C. For example, the arrangement is a matrix including rows and columns such as a 2×6 arrangement of articles. The blank can be alternatively configured to form a carton for packaging other articles and/or different arrangements of articles.

As used herein, the term "fold line" refers to all manner of lines that define hinge features of the blank, facilitate folding portions of the blank with respect to one another, or otherwise indicate optimal panel folding locations for the blank. A fold line is typically a scored line, an embossed line, or a debossed line.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

Referring to FIG. 1, the blank 100 includes a series of primary panels that define the walls of a tubular structure of the carton 200. The primary panels are aligned along a longitudinal axis of the blank 100 and are hingedly connected one to the next along fold lines that extend transversely with respect to the longitudinal axis. Specifically, the primary panels include a first side panel 110, a top panel 112, a second side panel 114, and a bottom panel 116. The first side panel 110 is hingedly connected to the top panel 112 along fold line 120, the top panel 112 is hingedly connected to the second side panel 114 along fold line 122, and the second side panel 114 is hingedly connected to the bottom panel 116 along fold line 124. The blank 100 further includes an edge flap 118 that facilitates securing the endmost primary panels to one another. In the exemplary embodiment, the edge flap 118 is hingedly connected to the first side panel 110 along a fold line 126. In alternative embodiments, the edge flap 118 is connected to the bottom panel 116 instead. Further, the primary panels can be alternatively sequenced, for instance, such that the top panel 112 is first, followed by the second side panel 114, the bottom panel 116, and then the first side panel 110.

End flaps are hingedly connected to opposite ends of each primary panel along fold lines that extend parallel to the longitudinal axis. The end flaps can be folded and secured to form end closure structures at respective open ends of the tubular structure of the carton 200 and thereby define the end walls of the carton 200. The blank 100 is substantially symmetric such that the end flaps that are hingedly connected to the opposite ends of each primary panel are substantially similar. Accordingly, the end closure structures of the carton 200 are substantially identical and like references have been used with a suffix "a" or "b" to distinguish one end of the carton 200 from the other. The description of an element or group of elements having a suffix "a" is suitable for a like-numbered element or group of elements having a suffix "b". In certain instances, for clarity, only one of the like elements may be described unless a description of the other or both of the like elements is useful for understanding the invention.

First side end flap 130*a* is hingedly connected to first side panel 110 along fold line 140*a*, top end flap 132*a* is hingedly connected to top panel 112 along fold line 142*a*, second side end flap 134*a* is hingedly connected to second side panel 114 along fold line 144*a*, and bottom end flap 136*a* is hingedly connected to bottom panel 116 along fold line 146*a*.

The blank 100 further includes a severance line 150 that defines a detachable portion 152 of the blank 100. The detachable portion 152 is dimensioned and positioned such that, as the blank 100 is erected to form the carton 200, the detachable portion 152 can be at least partially separated from the carton 200 to provide an opening in the carton through which articles C can be dispensed.

The detachable portion 152 can have any size or shape so as to provide a suitable opening for dispensing articles C and the illustrated version is provided as a non-limiting example. The exemplary detachable portion 152 is defined along an end edge of the blank 100 so as to include portions of end flaps 130*b*, 132*b*, 134*b* and portions of panels 110, 112, 114. Generally described, the detachable portion can include portions of one or more panels or end flaps.

The severance line 150 includes multiple severance line segments that extend across each of the panels and end flaps. Severance line segments 150*a*, 150*b* extend across the first and second end flaps 130*b*, 134*b* from the distal edges of the first and second end flaps 130*b*, 134*b* to the fold lines 140*b*, 144*b*, respectively. Severance line segments 150*c*, 150*d* extend across the first and second side panels 110, 114 from the fold lines 140*b*, 144*b* to the fold lines 120, 122, respectively. A severance line segment 150*e* extends across the top panel 112 between the fold lines 120, 122. A curved portion of severance line segment 150*e* and fold lines 156, 158 define a tear initiation tab 154. The severance line segments define the substantially continuous severance line 150. The exemplary severance line 150 and detachable portion 152 are symmetrical, although symmetry is not requisite for implementation.

It should be understood that the curvature or path of the severance line 150 is a design decision that can be determined according to the desired manufacturing process, aesthetic features, or functionality requirements. For example, the curvature of the severance line can be determined in part to optimally retain articles C in the carton and dispense articles C from the carton. Optionally, the path of the severance line 150 can be designed to facilitate the application of adhesive to the end flaps and panels of the carton.

Figure 2:
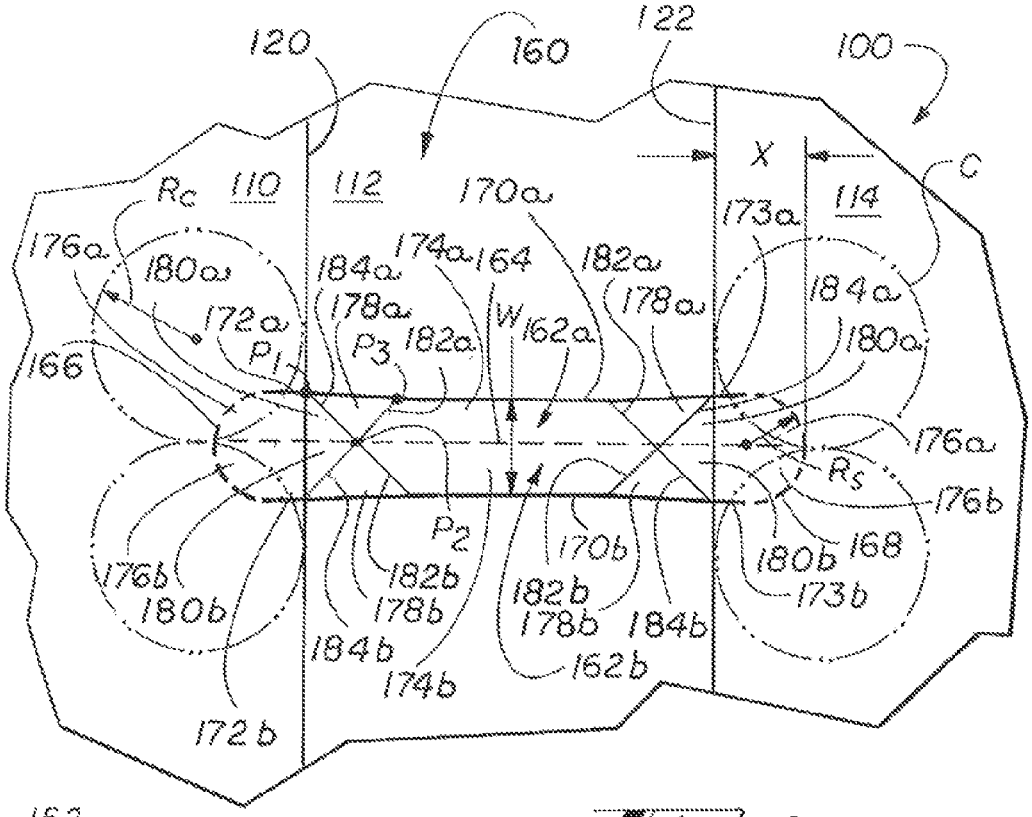
FIG. 2 is a partial plan view of the carton blank of FIG. 1, illustrating a handle of the carton blank.

Referring to FIGS. 1 and 2, the blank 100 further comprises a handle 160 that is configured to allow a user to carry the carton 200. The exemplary handle 160 includes an aperture that is initially filled in by handle flaps 162*a*, 162*b* that are at least partially removable. The handle flaps 162*a*, 162*b* are separable from one another along a severance line 164 and are separable from the side panels 110, 114 along semi-circular or arched severance lines 166, 168. The handle flaps 162*a*, 162*b* are hingedly connected to the top panel 112 along fold lines 170*a*, 170*b*, to the first side panel 110 along fold lines 172*a*, 172*b*, and to the second side panel 114 along folding lines 173*a*, 173*b*. In the embodiment illustrated in FIGS. 1 and 2, the fold lines 170, 172, 173 are substantially aligned or collinear (coplanar when in carton form).

The handle flap 162*a* is now described in further detail. It should be understood that the handle flap 162*b* is substantially similar to the handle flap 162*a* (the handle 160 is substantially symmetric about a longitudinal axis or severance line 164) and thus the description of handle flap 162*a* is applicable to handle flap 162*b*. Also, since the handle flap 162*a* is substantially symmetrical about a transverse axis (parallel to and halfway between fold lines 120, 122), like element numbers are used to identify like elements on each side of the transverse axis. For example, element numbers

176*a*, 178*a*, 180*a*, 182*a*, 184*a* identify like elements at each of opposed ends of the handle flap 162*a*.

Referring to FIG. 2, the handle flap 162*a* includes a main portion 174*a*, end portions 176*a*, 176*a*, and gussets 178*a*, 178*a*, 180*a*, 180*a* that connect the main portion 174*a* to the end portions 176*a*, 176*a*. The main portion 174*a* is hingedly connected to inner gussets 178*a*, 178*a* along fold lines 182*a*, 182*a*, each inner gusset 178*a* is hingedly connected to an outer gusset 180*a* along a fold line 184*a*, and each outer gusset 180*a* is hingedly connected to the respective end portion 176*a* along a segment of the respective fold line 120, 122. The main portion 174*a* and the inner gussets 178*a*, 178*a* are hingedly connected to the top panel 112 along top panel fold line 170*a* and the end portions 176*a*, 176*a* are hingedly connected to the side panels 110, 114 along fold lines 172*a*, 173*a*, respectively. The end portions 176*a*, 176*a* are separable from the side panels 110, 114 along arched severance lines 166, 168, respectively.

Fold lines 182*a*, 184*a* associated with one end of the handle flap 162*a* (adjacent fold line 120) are now described in further detail although the description is applicable to the fold lines 182*a*, 184*a* at the opposed end (adjacent fold line 122) of the handle flap 162*a* since the handle flap 162*a* is substantially symmetrical about a transverse center axis disposed perpendicular to the severance line 164. Fold line 184*a* extends between a point P1 on the fold line 120 and a point P2 on the severance line 164. Fold line 182*a* extends between the point P2 and a point P3 on the fold line 170*a*. The point P1 is preferably located at the intersection of fold lines 120 and 170*a*.

Generally, the fold lines 182*a*, 184*a* are configured such that the handle flap 162*a* places the outer gussets 180*a* and the end portions 176*a* in contact with an article C in the carton 200, as described in further detail below. In the embodiment of FIGS. 1 and 2, the fold lines 182*a*, 184*a* are substantially perpendicular to one another and are substantially at a forty-five degree angle with respect to the fold lines 170*a*, 120. Here, the gussets 178*a*, 180*a* are substantially in the shape of right triangles.

Referring to FIG. 2, the functionality of handle 160, described in further detail below, can be achieved with a number of different radii Rs for arched severance lines 166, 168, widths W for handle 160, and lengths X for end portions 176*a*. For purposes of teaching, exemplary ranges are provided in terms of a radius Rc of an exemplary article C. For example, a standard twelve-ounce beverage has a radius Rc of 1.3 inches. In general, the length X of the end portion 176*a* is between 0.25*Rc and 1*Rc, the width W of the handle 160 is between 0.5*Rc and 1.5*Rc, and the radius Rs of the arched severance line 166, 168 is between 0.25*Rc and 0.8*Rc. Further, the radius Rs of the arched severance line 166, 168 is less than the length X and greater than 0.5 times the length X. For example, for a standard twelve-ounce beverage can, the length X of the end portion 176*a* is one inch and the width W of the handle 160 is nineteen sixteenths of an inch.

Erecting the carton 200 from the blank 100 may be accomplished with the folding operations as described herein. The operations can be performed by automatic erecting machinery and/or manually. The method of performing the erecting process is not limited to the exemplary method described herein. Particularly, the order of the steps can be altered according to manufacturing requirements, steps may be added or omitted, and the means for securing components to one another may vary. The surfaces of sheet material may be secured together by suitable means for securing, such suitable securing means including tape, staples, interlocking folds, VELCRO®, glue or other adhesives, combinations thereof, and the like.

Referring to FIG. 1, the blank 100 can be folded and secured to form a collapsed tubular structure by folding the edge flap 118 along the fold line 126 such that the inside surface of the edge flap 118 is in flat face contact with the inside surface of the first side panel 110, applying glue or other adhesive to the outside surface of the edge flap 118, and folding the blank 100 along the fold line 122 such that the inside surface of the bottom panel 116 is in flat face contact with, and thereby secured to, the outside surface of the edge flap 118.

Figure 3:
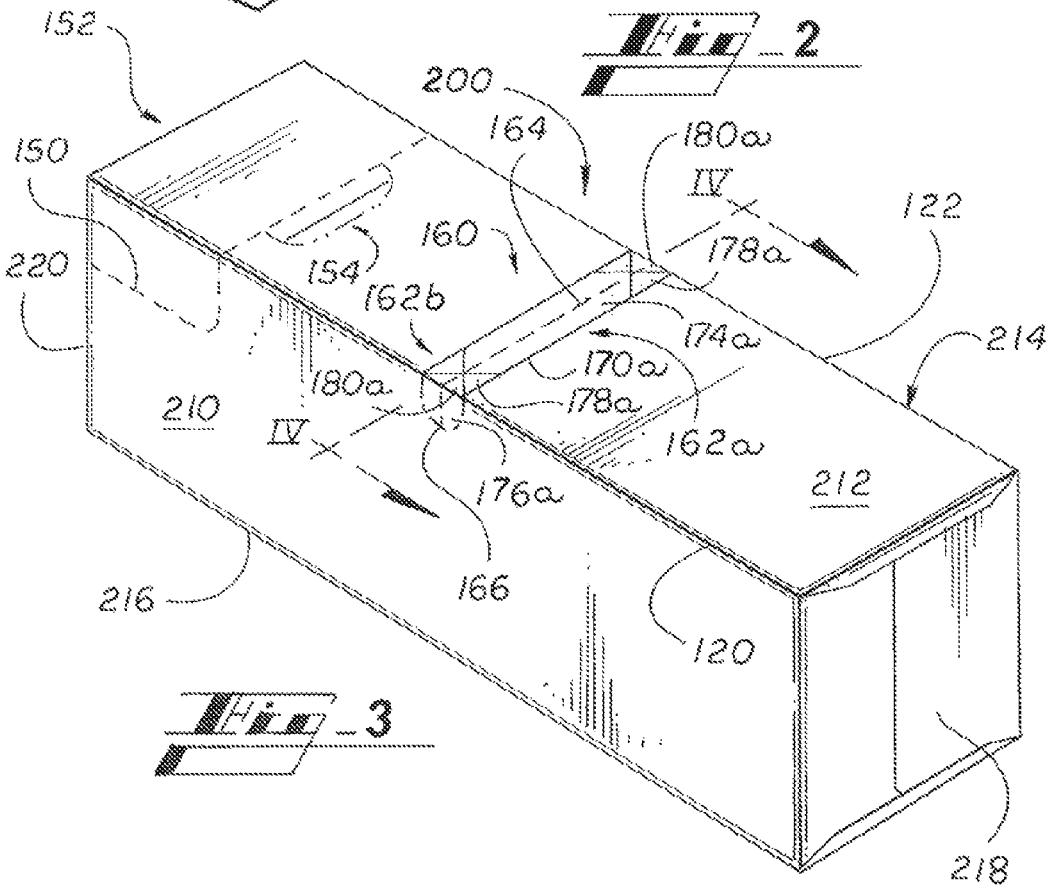
FIG. 3 is a perspective view of a carton formed from the blank of FIG. 1.

The tubular structure can thereafter be erected from the collapsed tubular structure such that the primary panels form the was of the tubular structure. Referring to FIGS. 1 and 3, the first side panel 110 forms a first side wall 210, the top panel 112 forms a top wall 212, the second side panel 114 forms a second side wall 214, and the bottom panel 116 forms the bottom wall 216. The tubular structure of the carton includes open ends through which articles can be loaded. It should be understood that the end flaps can be folded outwardly or otherwise so as not to obstruct articles as they are loaded through one or both of the open ends.

Continuing with FIGS. 1 and 3, the end closure structures of the carton 200 are formed by folding the end flaps as described herein. Top and bottom end flaps 132*a*, 136*a* are folded inwardly toward the open end of the tubular structure along fold lines 142*a*, 146*a* so as to be substantially coplanar with one another. First and second side end flaps 130*a*, 134*a* are folded inwardly toward the open end of the tubular structure along fold lines 140*a*, 144*a* to be substantially coplanar with one another. The first and second side end flaps 130*a*, 134*a* overlap the top and bottom end flaps 132*a*, 136*a* and overlap one another. Glue or other adhesive is applied to the overlapping portions of the end flaps can be secured together such that the end flaps form the end closure structure. Thereby, the end closure structures of the carton 200 are formed, as shown in FIG. 3, and the carton 200 is fully erected. The primary panels that define the tubular structure portion and the end closure structures define end walls 218, 220 of the carton 200.

The cartons illustrated in the drawings are adapted to hold a group of similarly dimensioned, preferably cylindrical articles C (such as cans or bottles), in a matrix arrangement of rows (or tiers) and columns. Here, the articles in each row are disposed on their sides in a side-by-side parallel fashion with the ends of the articles disposed alongside the side walls 210, 214 of the carton 200. The sides of the articles are disposed alongside the top wall 212, bottom wall 216, and end walls 218, 220 of the carton 200. The handle 160 is positioned with respect to an open space defined by the sides of two adjacent articles such that a user can fold the handle 160 into the carton 200 as described in further detail below.

Figure 4:
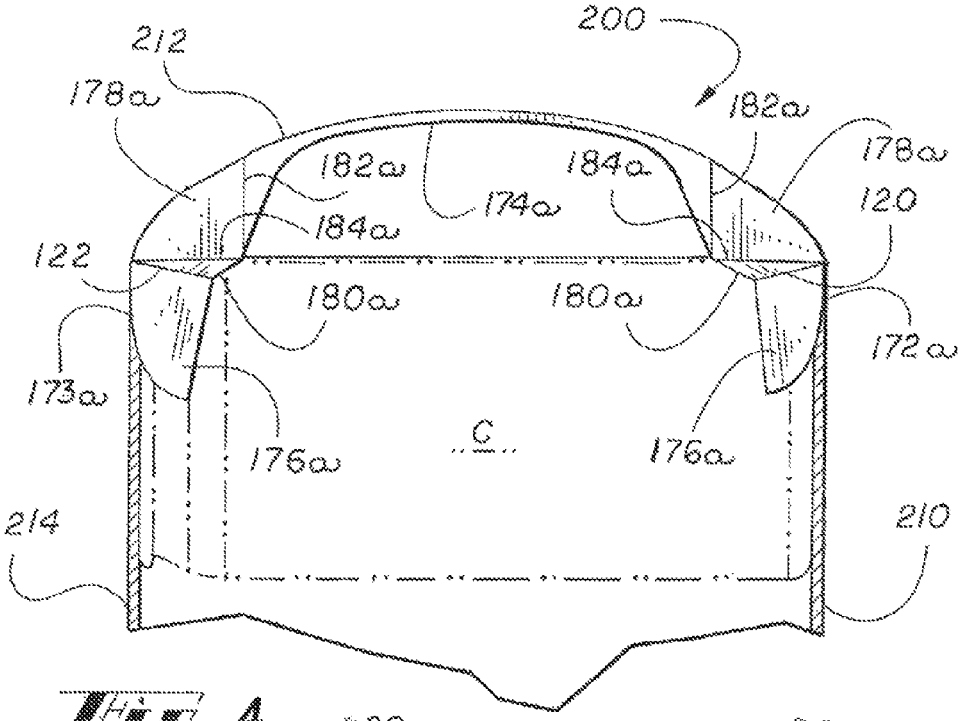
FIG. 4 is a partial cross-sectional elevational view of the carton of FIG. 3 illustrating the handle when engaged to carry the carton.

Referring to FIGS. 2-4, to operate the handle 160, the user inserts a hand through the aperture of handle 160 into the open space between two adjacent articles C to break the severance line 164 and fold the main portion 174*a* of the handle flap 162*a* into the open space. The main portion 174*a* is further folded approximately one-hundred eighty degrees into flat face contact with the inside of the top wall 212. Thereafter, as illustrated in FIG. 4, the user can lift the carton 200 by applying force where the main portion 174*a* overlaps the top wall 212 and the fold line 170*a* provides a rounded edge that is comfortable to the user when applying such force. The lifting causes the top wall 212 to bow as illustrated in FIG. 4.

Continuing with FIG. 4, as the main portion 174*a* is folded into contact with the top wall 212, the gussets 178*a*, 180*a* fold along the fold lines 182*a*, 184*a*, 120, 122 and the end portions 176*a* fold along the fold lines 172*a*, 173*a*, 120, 122 to place the outer gussets 180*a* and the end portions 176*a* into contact with the adjacent article C. Generally, the inner gussets 178*a* provide a transition between the main portion 174*a* and the portions of the handle flap 162*a* that contact and fold around each end of an adjacent article C—outer gussets 180*a* and end portions 176*a*. As such, the inner gussets 178*a* function to prevent the outer gussets 180*a* and end portions 176*a* from undergoing excessive tension, which may occur were the inner gussets 178*a* omitted since the outer gussets 180*a* and the end portions 176*a* would be folded to a greater degree and apply a greater force to the adjacent article C.

Through well-placed fold lines 182*a*, 184*a*, the gussets 178*a*, 180*a* and end portions 176*a* provide a structure that increases the strength of the handle 160. The upward lift that is applied to the main portion 174*a* of the handle 160 and top wall 212 is supported by the contact of the outer gussets 180*a* and end portions 176*a* with the ends of the adjacent article C. As such, the forces that are applied through engaging the handle 160 and lifting the carton 200 are distributed and less likely to cause tearing of the carton 200. Similarly, the arched severance lines 166, 168 are configured to distribute stresses along the length thereof, instead of concentrating stress at a termination point.

Figure 5:
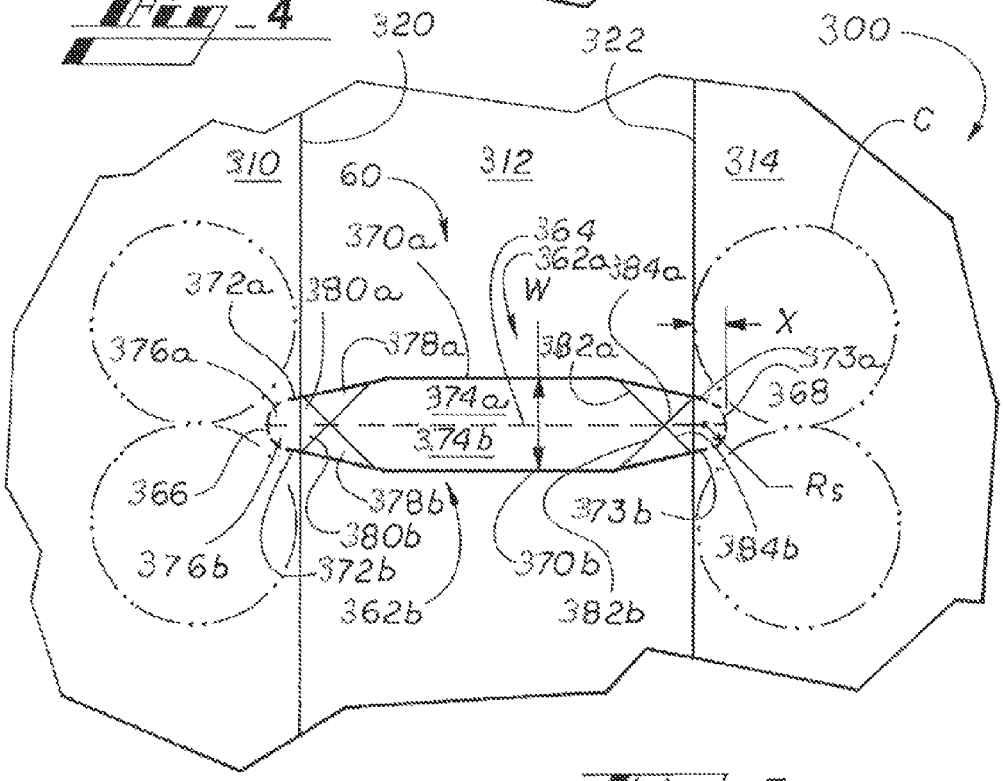
FIG. 5 is a plan view of an alternative embodiment of a carton blank, in accordance with an exemplary embodiment of the present invention.

Turning now to FIG. 5, a blank 300 of a second embodiment of the invention is disclosed. The blank of the second embodiment is similar to that of the first embodiment illustrated in FIGS. 1 and 2 and substantially only the difference between the two embodiments will be described below. Like features have been numbered with like reference numerals, raised by '200' to denote the blank of the second embodiment for the purpose of avoiding redundant description. The handle 360 features a smaller length X and a smaller radius Rs. Further, the handle 360 tapers from the main portions 374 towards the end portions 376 and includes fold lines 370, 372, 373 that are nonlinear with respect to one another. The fold lines 382, 384 remain substantially perpendicular to one another. However, here, the inner gusset 378 is larger than the outer gusset 380 and is a triangle with the two sides that form the right angle having different lengths.

Figure 6:
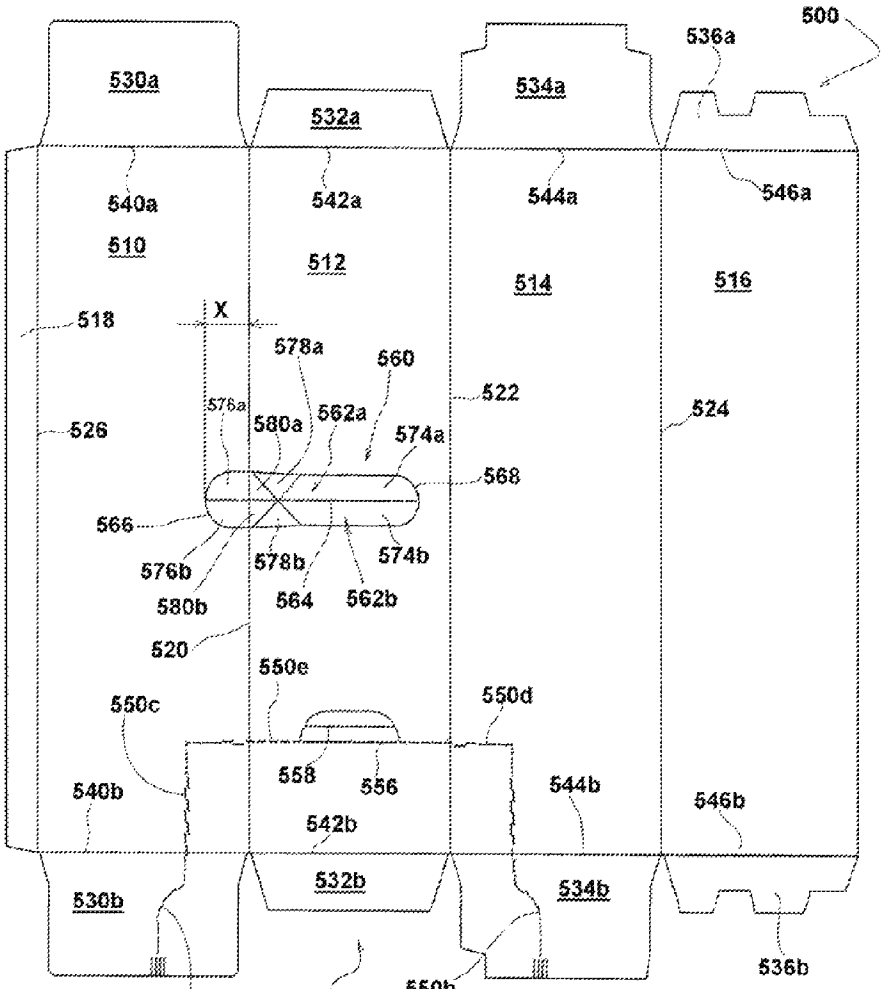
FIG. 6 illustrates a blank of a third embodiment of the invention.

FIG. 6 illustrates a blank 500 of a third embodiment of the invention which is similar to that of the first embodiment illustrated in FIGS. 1 and 2 and substantially only the difference between the two embodiments will be described below. Like features have been numbered with like reference numerals, raised by '400' to denote the blank of the third embodiment for the purpose of avoiding redundant description. The handle 560 features a pair of handle flaps 562*a*, 562*b* each having a single end portion 576*a*, 576*b* that is formed from part of the first side panel 510. The other end of each handle flap 562*a*, 562*b* terminates at a semi-circular or arched severance line 568 in the top panel 512 without extending into the second side panel 514. The arched severance line 568 is spaced apart from the fold line (or hinged connection) 522 between the top panel 512 and the second side panel 514. A preferred distance between the arched severance line 568 and the fold line 522 is about ⅞ of an inch when the blank 500 is designed for the standard 12 ounce can. The handle 560 may taper from the end portion 576*a* towards the main portion 574*a*.

The present invention has been illustrated in relation to particular embodiments that are intended in all respects to be illustrative rather than restrictive. Those skilled in the art will recognize that the present invention is capable of many modifications and variations without departing from the scope of the invention. For example, as used herein, directional references such as top, base, bottom, end, side, inner, outer, upper, middle, lower, front, and rear do not limit the respective walls of the carton to such orientation, but merely serve to distinguish these walls from one another. Any reference to hinged connection should not be construed as necessarily referring to a junction including a single hinge only; indeed, it is envisaged that hinged connection can be formed from one or more potentially disparate means for hingedly connecting materials.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

We claim:

1. A carton comprising:

a substantially tubular structure including a top wall and first and second side was hingedly connected respectively to opposed edges of the top wall; and a handle formed in the top wall and at least one of the first and second side walls, the handle including a handle flap which comprises:

a main portion formed from part of the top wall; and a first end portion formed from part of the at least one of the first and second side walls, wherein the main portion is hingedly connected to the first end portion through at least one fold line, wherein the at least one of the first and second side walls comprises an arched severance line that at least partially defines the first end portion, wherein the first end portion has a length defined by a distance between the top wall and a point on the arched severance line that is furthermost from the top wall, and wherein a radius of the arched severance line is greater than a half of the length of the first end portion and less than the length of the first end portion.

2. The carton of claim 1, wherein the main portion is hingedly connected to the top wall along a top wall fold line, wherein the at least one fold line comprises second and third fold lines, the third fold line being substantially collinear with a hinged connection between the top wall and the at least one of the first and second side walls, the second fold line extending from a first point on the top wall fold line to a second point on a free end edge of the handle flap such that an outer gusset is defined between the second and third fold lines, the outer gusset connecting between the first end portion and the main portion.

3. The carton of claim 2, wherein the at least one fold line further comprises a first fold line extending from the second point to a third point on the top wall fold line such that an inner gusset is defined between the first and second fold lines, the inner gusset connecting between the outer gusset and the main portion.

4. A carton comprising:

a substantially tubular structure including a top wall and first and second side walls hingedly connected respectively to opposed edges of the top wall; and a handle formed in the top wall and at least one of the first and second side walls, the handle including a handle flap which comprises:

a main portion formed from part of the top wall;

a first gusset and a second gusset formed from part of the top wall; and a first end portion formed from part of the at least one of the first and second side walls, wherein the main portion is hingedly connected to the first gusset along a first fold line, the first gusset is hingedly connected to the second gusset along a second fold line, the second gusset is hingedly connected to the first end portion along a third fold line that is substantially collinear with a hinged connection between the top wall and the at least one of the first and second side walls, and the main portion and the first gusset are hingedly connected to the top wall along a fourth fold line.

5. The carton of claim 4, wherein each of the first gusset and the second gusset have the shape of a right triangle.

6. The carton of claim 4, wherein the first end portion is hingedly connected to the at least one of the first and second side walls along a fifth fold line, and the fourth fold line and the fifth fold line are substantially continuous.

7. The carton of claim 4, wherein the first gusset is larger than the second gusset.

8. A blank for forming a carton, the blank comprising:

a series of panels for forming a substantially tubular structure, the series of panels including a top panel and first and second side panels hingedly connected respectively to opposed edges of the top panel; and a handle formed in the top panel and at least one of first and second side panels, the handle including a handle flap which comprises:

a main portion formed from part of the top panel;

a first gusset and a second gusset formed from part of the top panel; and a first end portion formed from part of the at least one of the first and second side panels, wherein the main portion is hingedly connected to the first gusset along a first fold line, the first gusset is hingedly connected to the second gusset along a second fold line, and the second gusset is hingedly connected to the first end portion along a third fold line that is substantially collinear with a hinged connection between the top panel and the at least one of the first and second side panels, wherein the main portion and the first gusset are hingedly connected to the top panel along a fourth fold line.

9. The blank of claim 8, wherein the first end portion is hingedly connected to the at least one of the first and second side panels along a fifth fold line, and the fourth fold line and the fifth fold line are substantially continuous.

10. The blank of claim 8, wherein the first gusset is larger than the second gusset.

11. A blank for forming a carton, the blank comprising:

a series of panels for forming a substantially tubular structure, the series of panels including a top panel and first and second side panels hingedly connected respectively to opposed edges of the top panel; and a handle formed in the top panel and at least one of the first and second side panels, the handle including a handle flap which comprises:

a main portion formed from part of the top panel; and a first end portion formed from part of the at least one of the first and second side panels, wherein the main portion is hingedly connected to the first end portion through at least one fold line, wherein the at least one of the first and second side panels comprises an arched severance line that at least partially defines the first end portion, wherein the first end portion has a length defined by a distance between the top panel and a point on the arched severance line that is furthermost from the top panel, and wherein a radius of the arched severance line is greater than a half of the length of the first end portion and less than the length of the first end portion.

12. The blank of claim 11, wherein the handle flap further comprises a first gusset and a second gusset formed from part of the top panel wherein the main portion is hingedly connected to the first gusset along a first fold line, the first gusset is hingedly connected to the second gusset along a second fold line, and the second gusset is hingedly connected to the first end portion along a third fold line that is substantially collinear with a hinged connection between the top panel and the at least one of the first and second side panels, and wherein the at least one fold line comprises the first, second and third fold lines.

* * * * *